United States Patent [19]

Plowman et al.

[11] Patent Number: 4,756,355

[45] Date of Patent: Jul. 12, 1988

[54] REFRACTORY HOLLOWWARE AND METHOD OF CASTING USING HOLLOWWARE TO REMOVE NON-METALLIC INCLUSIONS FROM MOLTEN METAL

[75] Inventors: Andrew M. Plowman, Brierley Hill; David L. Jones, Birmingham, both of United Kingdom

[73] Assignee: Foseco International Limited, Birmingham, England

[21] Appl. No.: 48,807

[22] Filed: May 12, 1987

[30] Foreign Application Priority Data

May 22, 1986 [GB] United Kingdom ..... 8612474
Feb. 20, 1987 [GB] United Kingdom ..... 8704015

[51] Int. Cl.[4] ..... B22C 9/08; B22D 35/04

[52] U.S. Cl. ..... 164/134; 164/362; 249/109

[58] Field of Search ..... 164/133, 134, 362, 363; 249/109, 187 R

[56] References Cited

U.S. PATENT DOCUMENTS

| | | | |
|---|---|---|---|
| 508,884 | 11/1893 | James | 164/362 |
| 1,385,201 | 7/1921 | Chapple | 164/362 |
| 3,672,432 | 6/1972 | Widdowson et al. | 164/133 X |
| 4,359,202 | 11/1982 | Gerding et al. | 164/133 X |

FOREIGN PATENT DOCUMENTS

| | | | |
|---|---|---|---|
| 1131366 | 6/1962 | Fed. Rep. of Germany | 249/109 |
| 766823 | 6/1957 | United Kingdom . | |
| 1029543 | 5/1966 | United Kingdom . | |
| 341583 | 7/1972 | U.S.S.R. | 249/109 |

*Primary Examiner*—Nicholas P. Godici
*Assistant Examiner*—J. Reed Batten, Jr.
*Attorney, Agent, or Firm*—Nixon & Vanderhye

[57] ABSTRACT

An article of refractory hollowware for use in a runner assembly for casting molten metals e.g. ferrous metals, has at least one inner surface adapted to increase the internal surface contact area of the article. The surface is so arranged as to effect at least two abrupt changes of direction of flow of molten metal flowing through the article. Use of the article minimizes the level of non-metallic inclusions in ingots and castings.

21 Claims, 2 Drawing Sheets

Figure 1:
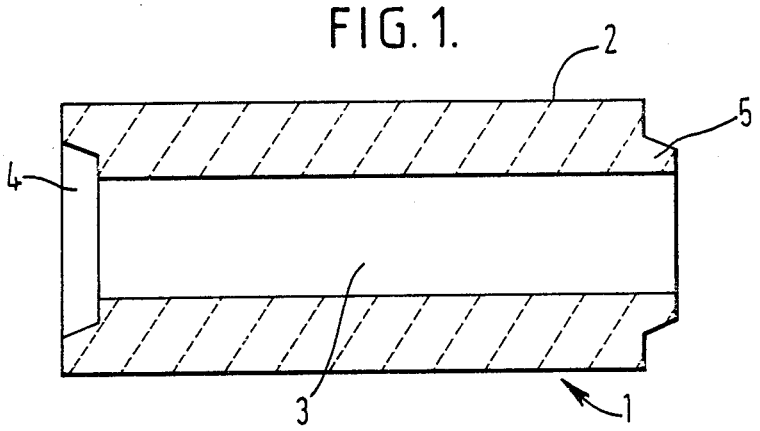
PRIOR ART FIG. 1.

REFRACTORY HOLLOWWARE AND METHOD OF CASTING USING HOLLOWWARE TO REMOVE NON-METALLIC INCLUSIONS FROM MOLTEN METAL

This invention relates to the casting of metals more especially molten ferrous metals. The invention includes articles for use in runner systems and to methods of casting using such articles.

When casting molten ferrous metals such as iron or steel into ingot moulds or casting moulds e.g. sand moulds, it is known that the molten metal may contain undersirable non-metallic particles usually referred to as inclusions. The inclusions generally emanate from the refractories and/or metallurgical slags by which the molten metal has been contacted during its manufacture, its subsequent treatment and/or containment on route to the casting site. Although the inclusions are lower density than the metal and should therefore float to the surface of the solidifying ingot or casting the inclusions are often entrapped within the body of the ingot or casting with the result that the metallurgical properties of the metal are adversely affected by the non-metallic contamination. This problem is becoming less tolerable as higher demands are placed on iron and steel producers for higher quality products for use in the e.g. aerospace, automotive, and construction industries.

The production of ingots of ferrous metals by bottom casting or uphill teeming generally involves producing a plurality of ingots from one source of molten metal i.e. one ladleful of molten metal is distributed to several ingot moulds simultaneously. Generally, the metal is poured down a hollow refractory cylinder having a flared end uppermost, a so-called refractory trumpet, into and through a hollow refractory distributor located at the foot of the trumpet. The metal continues to flow from the distributor into a plurality of generally horizontal radially disposed hollow refractory runners having a straight through bore into the bottom of a corresponding plurality of ingot moulds and thus form ingots. For the sake of clarity the following description refers chiefly to the casting of ingots but it is to be appreciated that the invention is also applicable to the casting of intricate castings e.g. of steel, produced in sand moulds using a runner system located between the cope and drag portions of the mould assembly.

The refractory items mentioned above are usually referred to collectively as runner assembly refractory hollowware. For convenience of use the hollowware is usually in the form of a plurality of interfitting sections having relatively simply socket and spigot joints.

Unfortunately, the refractories used to form the hollowware may also contribute to the problem of inclusions which is particularly unfortunate as the molten metal may have undergone treatment to reduce the incidence of extraneous non-metallic matter prior to pouring into the hollowware. As these inclusions detract from the quality of the finally cast ingot their presence is clearly undesirable.

We have now found that the level of inclusions in ferrous metal ingots and other castings may be minimised by using a casting assembly in which at least one runner section comprises means to trap inclusions whilst permitting a suitable flow rate of metal through the runner.

According to the present invention there is provided an article of refractory hollowware for use in a runner assembly for casting molten metals having at least one inner surface adapted to increase the internal surface contact area of the article and so arranged as to effect at least two abrupt changes of direction of flow of molten metal flowing through the article.

The increase in the internal surface contact area of the article of the invention compared with a similar article having only a single linear bore is generally at least two but may be as high as 100 times. Preferably, the increase in surface area will be from about two to twenty times.

The article of the invention is particularly suitable for enhancing the removal of non-metallic inclusions such as alluminous inclusions e.g. alumina or alumino-silicates but other inclusions such as zirconia, silica, calcium aluminates, calcium silicates or calcium alumino-silicates may also be minimised.

The increased internal surface of contact of the article may be provided by means of a tortuous path e.g. by means of a labyrinthine or zig-zag path. The latter may comprise one or more series of regular inclining and declining paths extending from an inlet port to an outlet port.

The use of such an article of hollowware has been found to be very efficacious in the removal of alumina inclusions. The inclusions were found to be adsorbed onto the internal surfaces of the hollowware and also deposited at the juncture where the flow of metal is interrupted abruptly between adjacent inclining and declining surfaces. The tortuous path may be orientated horizontally or in any other plane.

The increased internal surface contact area of the hollowware of the present invention may arise from a combination of a labrinthine path, zig-zag path or other tortuous path and at least one throughgoing linear bore. In this way the internal surface area will be increased further thus enhancing the removal of inclusions from molten ferrous metal passing therethrough.

Furthermore, the article of the invention may also serve as a means for reducing the initial velocity of the molten stream thus reducing the "fountain effect" without adversely affecting the pouring rate of the molten metal stream.

The hollowware of the present invention may simply replace a conventional refractory hollowware article which otherwise may have been used in any particular casting runner assembly. This feature is particularly advantageous as it does not necessitate a foundry or steelworks to change its current workshop practice or apparatus to accommodate an article of the invention.

An article of refractory hollowware according to the present invention may be used in the production of steel castings by incorporating the article as part of the runner assembly during mould preparation. The hollowware may be used for steel castings having a mass of about 200 kg or more. For convenience the hollowware may be situated anywhere along the runner assembly but it has been found preferable to site the hollowware approximately adjacent to the inlet of the mould cavity.

Known methods of forming refractory hollowware may be employed to form the articles of the present invention such as refractory casting techniques e.g. particulate refractory material bonded with refractory cement. One method of forming an article of the invention having an internal zig-zag path is to prepare an accurately dimensioned polystyrene core (or other a sacrificial material such as paper or wax) to define the internal zig-zag passageway.

The refractory for the hollowware is cast around the core which may include suitable inlet and outlet ports in a suitable mould so spaced away from the core that the desired outer wall thickness of the hollowware is obtained. Once cast the hollowware is dried, demoulded and fired to remove the sacrificial core material and harden the refractory to produce an article of refractory hollowware having an integral internal surface defining the exact zig-zag configuration provided by the core material.

Preferably the internal surfaces of the holloware are formed as smooth as possible. Internal surfaces which are not generally smooth lend themselves as a potential source of inclusions since they are more easily eroded than smooth surfaces.

The refractory material may be selected from any of the known high quality refractories compatible with molten ferrous metals such as steel. Particularly preferred materials are alumina, magnesite, mullite, silica, zirconia or mixtures of any of these. The materials may be fused, sintered or bonded by means of e.g. a refractory cement such as high alumina or calcium aluminate cement.

The use of high quality refractory material renders it possible to provide the articles of the invention with an outer shell having a significantly thinner wall thickness than conventional runner sections formed of fireclay or other similar low quality refractory material. The thinner wall thickness does not however adversely affect the integrity or strength of the articles of the invention which exhibit satisfactory resistance to both mechanical and thermal shock. Furthermore, by virtue of effectively minimising the wall thickness of the article of the invention it may be readily appreciated that this also contributes to an increase in the internal surface area of the article compared with a conventional article having the same external dimensions and cross-section but having thick walls.

Figure 2:
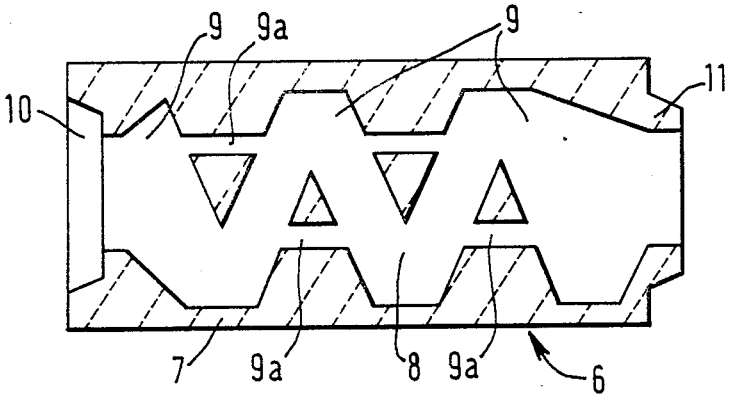
Figure 3:
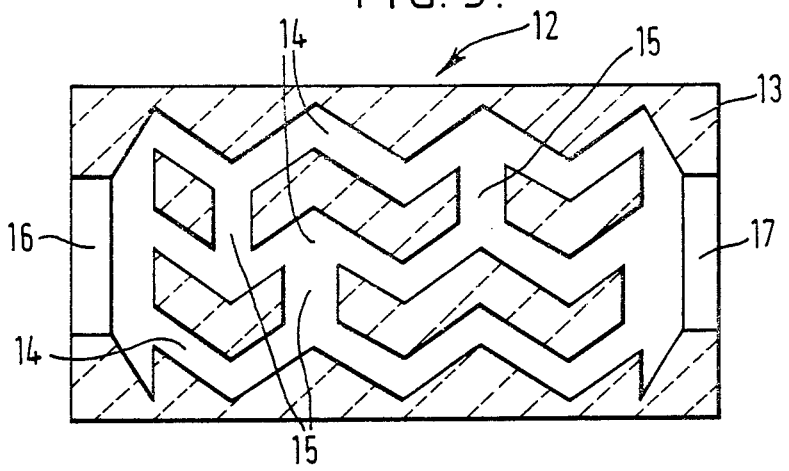
Figure 4:
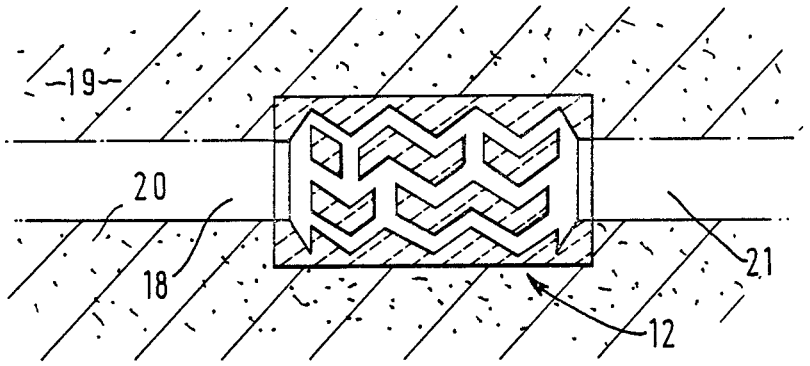

The invention is further described with reference to the accompanying schematic drawings in which:

FIG. 1. is a longitudinal section of part of a conventional runner assembly showing its internal passageway, FIG. 2. is a longitudinal section of a part of a runner assembly according to a specific embodiment of the present invention showing a zig-zag passageway and a plurality of throughgoing linear bores, FIG. 3. is a longitudinal section of a part of a runner assembly according to a specific embodiment of the invention showing a plurality of interconnected zig-zag passageways, FIG. 4. is a longitudinal section showing the use of an article as illustrated in FIG. 3 in use in a steel casting runner assembly.

Referring to FIG. 1 there is shown a part of a conventional runner assembly hollowware 1 having a square external cross-section and thick side walls 2. The cylindrical bore 3 traverses between socket 4 and spigot 5 for engagement with other parts of a bottom runner assembly (not shown). In FIG. 2. the hollowware 6 has relatively thin side walls 7 also of square external cross-section. The internal passageway 8 is defined by a tortuous zig-zag path 9 and a plurality of linear bores 9*a* traversing between socket 10 and spigot 11. Socket 10 and spigot 11 are suitably dimensioned to co-operate with matching sockets and spigots of conventional runner hollowware.

In FIGS. 3 and 4, the hollowware 12 has relatively thin side walls 13 of square cross-section. The internal passageway is defined by a plurality of tortuous zig-zag pathways 14 which are inter-connected by means of a plurality of pathways 15. The internal passageway traverses between sockets 16 and 17 also having a square cross-section and dimensioned to co-operate substantially with the conventional runner channel 18 formed between the sand mould halves 19 and 20. The hollowware 12 is shown adjacent the ingate 21 which communicates with the mould cavity (not shown).

By labyrinthine tortuous path is meant a pathway having multiple changes of direction of flow with surfaces in the flow path dividing the flow into at least two discrete flow paths.

The invention is further illustrated below with reference to the following comparative examples:

EXAMPLE I

A small scale experimental test was conducted using a conventional six-piece refractory bottom casting assembly comprising a two-part trumpet, a distributor brick, two horizontal bottom runner sections and an inlet leading to a 500 kg cast iron ingot mould. The test was repeated several times in order to evaluate several different hollowware sections according to the invention where each section tested had a different internal surface contact area. On each occasion the bottom runner section immediately prior to the inlet was replaced with a section of hollowware according to the invention except for the test (Test 1) conducted on a wholly conventional bottom casting assembly comprising runner sections having a straight through bore. The hollowware sections according to the invention were of designs generally similar to that of FIG. 2.

The results of the comparative trial in which aluminium-killed molten steel was poured at a temperature of 1600° C. in each case are shown in Table 1:

TABLE 1

| TEST NO. | POURING TIME | POURING RATE | INTERNAL SURFACE CONTACT AREA | INCLUSIONS REMOVED |
|---|---|---|---|---|
| 1 | 30 secs | 16.66 kg/sec | 1 | — |
| 2 | 45 secs | 11.11 kg/sec | 2 | 30–50% |
| 3 | 39 secs | 12.82 kg/sec | 4 | 40–60% |
| 4 | 33 secs | 15.15 kg/sec | 6 | 60–80% |

The internal surface contact areas given above for Tests 2, 3 and 4 are relative to that for Test 1 which is assigned a value of 1. After the steel had been cast, in each case the last runner section (containing solidified steel) was longitudinally sectioned and the cut surface polished. Photomicrographs of the polished surface were taken and the 'inclusions removed' figures given above obtained by inspection of the photomicrographs. In the case of Test 1 the inspection revealed no removal of inclusions.

EXAMPLE II

An experimental foundry test was conducted using conventional sand moulding practice for producing intricate shaped steel castings. The test was performed in two parts in one case using a wholly conventional runner assembly and in the other case part of the runner assembly was adapted to accommodate an article of refractory hollowware substantially as shown in FIG. 3 above. In the case where the hollowware was used it was positioned approximately 30 mm away from the ingate to the mould cavity. In both cases approximately 500 kg of low carbon steel having a nominal carbon content of 0.2% and aluminium killed in a ladle was used to cast an intricate casting of steel. The thus killed steel was poured into each runner assembly whilst at a temperature of 1590° C. It was observed that when the test using the hollowware was performed approximately 7 seconds elapsed as the hollowware was filled and a further 20 seconds taken to obtain an optimum flow rate.

The pouring rate during the period of steady flow was 7.5 kg/sec. The internal surface contact area of that length of the runner used in the first part of the test and having the same length as the hollowware used in the second part of the test was assigned a value of 1. In comparison the internal surface contact area of hollowware had a value of 3.

The proportion of inclusions removed by the hollowware was 40–60%.

We claim:

1. An article of refractory hollowware for use in a runner assembly for casting molten metals wherein the article is elongated and has a plurality of inner surfaces adapted to increase the internal surface contact area of the article and so arranged as to effect multiple abrupt changes of direction of flow of molten metal flowing through the article, said increased internal surface contact area of the article being provided by a labyrinthine tortuous path having multiple changes of direction of flow with surfaces in the path dividing the flow into at least two discrete flow paths, whereby non-metallic inclusions are removable from the molten metal by adherence to and deposition on the inner surfaces of the article.

2. An article according to claim 1 wherein the tortuous path is a zig-zag path.

3. An article according to claim 1 wherein the article has at least one linear bore connecting one part of the tortuous path with another part.

4. An article according to claim 1 wherein the article has an entrance socket and an exit spigot and wherein the increase in the internal surface area of the article compared with the internal surface contact area of a single linear bore extending through a similar article between its entrance socket and exit spigot is from 2 to 100 times.

5. An article according to claim 1 wherein the article has an entrance socket and an exit spigot and wherein the increase in the internal surface contact area of the article compared with the internal surface contact area of a single linear bore extending through a similar article between its entrance socket and exit spigot is from 2 to 20 times.

6. An article according to claim 1 wherein the article is formed from a fused, sintered or bonded refractory material.

7. An article according to claim 6 wherein the article is formed from a composition comprising a particulate refractory material and a refractory cement binder.

8. An article according to claim 7 wherein the particulate refractory material is selected from the group consisting of alumina, magnesite, mullite, silica and zirconia.

9. An article according to claim 7 wherein the binder is selected from the group consisting of high alumina or calcium aluminate cement.

10. An article according to claim 1 wherein the internal surface contact area of the article is smooth.

11. An article of refractory hollowware for use in a runner assembly for casting molten metals comprising an elongated body having an entrance socket and an exit spigot, said body having a plurality of discrete inner surfaces having dimensions to increase the internal surface contact area of the body with the molten metal passing therethrough in comparison with the internal surface contact area of a linear bore extending through a similar body between its entrance socket and exit spigot, said surfaces being arranged to effect abrupt changes of direction of flow of molten metal through the body with said surfaces dividing the flow into at least two discrete flow paths, said increased internal surface contact area being provided by a labyrinthine tortuous path.

12. A method of casting molten metal in a mould having a runner system connected thereto which method comprises providing a runner system comprising at least one article of refractory hollowware wherein said article has a plurality of inner surfaces arranged in a labyrinthine tortuous path to increase the internal surface contact area of the article and so arranged as to effect multiple abrupt changes of direction of flow of molten metal flowing through said article with said surfaces in the path dividing the flow into at least two discrete flow paths and pouring molten metal through the runner system into the mould in order to remove non-metallic inclusions from the molten metal.

13. A method according to claim 12 in which the runner system is connected to an ingot mould.

14. A method according to claim 12 in which the runner system is connected to a casting mould.

15. A method according to claim 14 in which the casting mould is a sand mould.

16. A method according to claim 12 in which the molten metal is a ferrous metal.

17. A method of casting molten metal in a mold having a runner system which includes at least one article of refractory hollowware having an internal tortuous path, comprising the steps of;

(a) pouring molten metal having NON-metallic inclusions into the runner system;

(b) causing the poured molten metal to effect at least two abrupt changes of direction to trap with surfaces in the flow path dividing the flow into at least two discrete flow pathways and remove the non-metallic inclusions from the molten metal, and (c) discharging the molten metal, with non-metallic inclusions removed therefrom, into the mold.

18. A method as recited in claim 17 wherein step (b) is practiced by passing the molten metal through a labyrinthine.

19. A method as recited in claim 17 wherein step (b) is practiced by causing the metal to flow through a zig-zag path.

20. A method as recited in claim 17 including providing the hollowware with an entrance socket and an exit spigot and increasing the internal surface contact area of the article in comparison with the internal surface contact area of a single linear bore extending through a similar article of hollowware between its entrance socket and its exit spigot.

21. A method as recited in claim 20 including increasing the internal surface contact area in such comparison at least 2 times.

* * * * *